US007316134B2

(12) United States Patent
Lee et al.

(10) Patent No.: US 7,316,134 B2
(45) **Date of Patent: *Jan. 8, 2008**

(54) WASHING MACHINE WITH WOBBLING UNIT AND CLUTCH

(75) Inventors: Myung-Gyu Lee, Suwon (KR); Hyung-Gyoon Kim, Suwon (KR); Chan-Woo Park, Anyang (KR); Sang-Goo Yoon, Kunpo (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 669 days.

This patent is subject to a terminal disclaimer.

(21) Appl. No.: 10/739,264

(22) Filed: Dec. 19, 2003

(65) Prior Publication Data

US 2004/0154354 A1 Aug. 12, 2004

(30) Foreign Application Priority Data

Feb. 11, 2003 (KR) ..... 10-2003-0008516

(51) Int. Cl.
*D06F 37/40* (2006.01)

(52) U.S. Cl. ..... 68/23.6; 68/33; 68/131; 68/141

(58) Field of Classification Search ..... 68/33, 68/133, 140, 141, 131, 132, 23.6
See application file for complete search history.

(56) References Cited

U.S. PATENT DOCUMENTS 4,440,004 A * 4/1984 Bochan ..... 68/23 R
6,115,863 A * 9/2000 Mason et al. ..... 8/159
6,158,072 A * 12/2000 Baek et al. ..... 8/159
6,986,271 B2 * 1/2006 Kim et al. ..... 68/23.6
2003/0034054 A1 * 2/2003 Lee et al. ..... 134/22.18

FOREIGN PATENT DOCUMENTS

| | | |
|---|---|---|
| JP | 41-12797 | 12/1957 |
| JP | 41-12797 | 7/1965 |
| JP | 55-158093 | 12/1980 |
| JP | 11-4990 | 1/1999 |

OTHER PUBLICATIONS

Japanese Office Action (dated Sep. 28, 2006) issued in Japanese Patent Application No. 2003-406450.

* cited by examiner

*Primary Examiner*—Michael Barr
*Assistant Examiner*—Jason Heckert
(74) *Attorney, Agent, or Firm*—Staas & Halsey LLP

(57) ABSTRACT

A washing machine with a wobbling unit including a washing plate which wobbles in a vertical direction without rotating, thus washing laundry. The wobbling unit further includes a vertical rotating shaft rotating by a washing shaft and an inclined rotating shaft provided at a predetermined position above the vertical rotating shaft. A first rotary member allows the vertical rotating shaft to rotate along with the inclined rotating shaft. A second rotary member rotatably receives the inclined rotating shaft therein. The wobbling unit also includes a projecting pin, a wobbling pin, and a leveling pin to control positions of the first and second rotary members. A position of the washing plate is changed to a level position or a wobbling position by an operation of the pins. Further, a clutch is mounted to the second rotary member so that the position of the washing plate is securely changed to a desired position.

33 Claims, 11 Drawing Sheets

WASHING MACHINE WITH WOBBLING UNIT AND CLUTCH

CROSS-REFERENCE TO RELATED APPLICATION

This application claims the benefit of Korean Patent Application No. 2003-8516, filed Feb. 11, 2003, in the Korean Intellectual Property Office, the disclosure of which is incorporated herein by reference.

BACKGROUND OF THE INVENTION

1. Field of the Invention

The present invention relates, in general, to washing machines and, more particularly, to a washing machine having a wobbling unit which wobbles a washing plate installed in a spin-drying tub, thus washing laundry.

2. Description of the Related Art

As is well known to those skilled in the art, a vertical shaft type washing machine is designed such that a cylindrical spin-drying tub and a cylindrical washing tub are vertically set in a housing, and a pulsator is installed in the cylindrical spin-drying tub and rotated in alternating directions, thus washing laundry inside the cylindrical spin-drying tub by forced water currents generated by the pulsator. FIG. 1 illustrates an interior of a conventional vertical shaft type washing machine.

As illustrated in FIG. 1, the conventional vertical shaft type washing machine 300 with a pulsator 4 includes a housing 1 which defines an external appearance of the washing machine. A washing tub 2 having a cylindrical shape is vertically set in the housing 1 and contains wash water therein. A cylindrical spin-drying tub 3 is rotatably and concentrically set in the washing tub 2. The cylindrical spin-drying tub 3 is perforated on a sidewall thereof to have a large number of spin-drying perforations 3*c*. The pulsator 4 is interiorly installed on a bottom of the cylindrical spin-drying tub 3, and generates wash water currents inside the cylindrical spin-drying tub 3. The washing machine has a drive motor 5 and a power transmission unit 6. The drive motor 5 and the power transmission unit 6 are installed in a space between a bottom of the washing tub 2 and a bottom of the housing 1 to selectively rotate the pulsator 4 and the cylindrical spin-drying tub 3.

The housing 1 is opened at a top thereof to allow a user to put laundry into or take out laundry from the cylindrical spin-drying tub 3. A door 7 is hinged to the top of the housing 1 to open or to close the cylindrical spin-drying tub 3. Further, a drain hose 8 extends from the bottom of the washing tub 2 to an outside of the housing 1 so as to discharge the wash water from the washing tub 2 to the outside of the housing 1 when a washing process is completed.

A spin-drying shaft support unit 9 is mounted to a bottom plate 3*a* of the cylindrical spin-drying tub 3 to connect a spin-drying shaft 6*a* of the power transmission unit 6 to the cylindrical spin-drying tub 3, so that the cylindrical spin-drying tub 3 is rotated by a rotation of the spin-drying shaft 6*a* at a spin-drying operation. A washing shaft 6*b* of the power transmission unit 6 passing through the spin-drying shaft 6*a* is connected to the pulsator 4 interiorly installed on the bottom of the cylindrical spin-drying tub 3, so that the pulsator 4 is rotated by a rotation of the washing shaft 6*b* at a washing operation.

In the conventional vertical shaft type washing machine, when the conventional vertical shaft type washing machine 300 operates after putting the laundry into the cylindrical spin-drying tub 3, water is supplied to the washing tub 2. Further, the washing shaft 6*b* of the power transmission unit 6 rotates in alternating directions by the drive motor 5, so the pulsator 4 is rotates in corresponding directions. By the rotation of the pulsator 4, the water currents are generated in the alternating directions, so the laundry is washed while being moved along with the water currents.

When the washing operation is complete after a predetermined period of time, the wash water is discharged to the outside through the drain hose 8. Further, a rinsing operation is performed to remove a detergent from the laundry. Thereafter, the spin-drying shaft 6*a* is rotated by the drive motor 5 so that the cylindrical spin-drying tub 3 rotates in a single direction at a high speed, thus spin-drying the laundry. Therefore, all operations to wash the laundry are completed.

However, the conventional vertical shaft type washing machine 300 is designed such that the laundry is washed by the water currents generated when the pulsator rotates in the alternating directions, so the laundry is also rotated in alternating directions, and thereby the laundry is twisted and is tangled together. Thus, the conventional vertical shaft type washing machine has a problem that the laundry is easily worn out and is damaged, and a user must disentangle the laundry when the washing process is complete, thus being inconvenient to use and causing a waste of time.

Further, the conventional vertical shaft type washing machine using the pulsator has another problem that the pulsator is rotated in the alternating directions at short intervals during the washing operation, so that a power consumption is increased and a life-span of the drive motor is shortened due to a repeated reversible rotation of the drive motor.

Since the conventional vertical shaft type washing machine 300 using the pulsator is designed to wash the laundry by forcibly moving the laundry clockwise and counterclockwise by the water currents, a large amount of the wash water must be supplied to the washing tub, so water consumption is increased and detergent consumption is increased due to the high water consumption. Thus, the conventional vertical shaft type washing machine has a further problem that it causes a waste of the water and causes environmental contamination due to a high detergent consumption. Since a saving of water and protection of environment have been increasingly stressed in recent years, the above-mentioned problems must be solved.

SUMMARY OF THE INVENTION

Accordingly, it is an aspect of the present invention to provide a washing machine which has a wobbling unit to wash laundry by wobbling a washing plate in a vertical direction without rotating the washing plate at a washing operation.

It is another aspect to provide a washing machine with a wobbling unit such that a washing plate rotates along with a washing shaft at a level position, and the washing plate is maintained at a preset wobbling angle at a wobbling position, thus effectively accomplishing a wobbling operation.

Additional aspects and/or advantages of the invention will be set forth in part in the description which follows and, in part, will be obvious from the description, or may be learned by practice of the invention.

The above and/or other aspects are achieved by providing a washing machine, including a washing shaft, and a wobbling unit mounted to the washing shaft so as to wash laundry by a wobbling operation. The wobbling unit includes an inclined rotating shaft, a first rotary member, a second rotary member, a washing plate, and a clutch. The inclined rotating shaft is inclinedly installed to form a predetermined angle with a longitudinal axis of the washing shaft. The first rotary member rotates along with the washing shaft and is provided with a first inclined surface. In this case, the first inclined surface is inclined to form a predetermined angle with a latitudinal axis of the washing shaft. The second rotary member is installed so as to rotate with respect to the first rotary member, and is provided with a second inclined surface corresponding to the first inclined surface of the first rotary member, with an axial bore being formed through the second rotary member to rotatably receive the inclined rotating shaft therein. The washing plate is positioned at a wobbling position when the second rotary member rotates in a first rotating direction, and positioned at a level position when the second rotary member is rotated in a second rotating direction. The clutch holds the second rotary member when a position of the washing plate is changed from the level position to the wobbling position, thus preventing the second rotary member from rotating along with the first rotary member.

A projecting pin is mounted to one of the washing shaft, the first rotary member and the inclined rotating shaft so that the projecting pin rotates along with one of the washing shaft, the first rotary member and the inclined rotating shaft, and a wobbling pin and a leveling pin are provided on the second rotary member to be spaced apart from each other by a predetermined interval.

The inclined rotating shaft may be received in the axial bore of the second rotary member projecting from an upper end of the second rotary member, and the projecting pin may horizontally extend from the inclined rotating shaft at a position above the second rotary member, and the leveling pin and the wobbling pin may be provided on the upper end of the second rotary member on opposite sides of a center of the second rotary member so that the leveling pin and the wobbling pin form an angle of 180° with each other. Thus, the projecting pin may come into contact with the wobbling pin so that a position of the washing plate is changed to the wobbling position, when the inclined rotating shaft rotates in the first rotating direction, and the projecting pin may come into contact with the leveling pin so that the position of the washing plate is changed to the level position, when the inclined rotating shaft rotates in the second rotating direction.

The first inclined surface is formed at an upper end of the first rotary member and the second inclined surface is formed at a lower end of the second rotary member, so the upper end of the second rotary member is horizontally positioned so that the washing plate is positioned at the level position, when the projecting pin comes into contact with the leveling pin, and the upper end of the second rotary member is inclinedly positioned so that the washing plate is positioned at the wobbling position, when the projecting pin comes into contact with the wobbling pin.

The first inclined surface of the first rotary member and the second inclined surface of the second rotary member may have an inclination angle of about 5° to 20°.

Further, a bearing may be interposed between the second rotary member and the washing plate to mount a support member to the second rotary member, so that the support member rotatably receives the second rotary member and the washing plate wobbles.

A plurality of projecting ribs are vertically provided on an outer surface of the support member, and a plurality of grooves are provided on an inner surface of a hole formed at a center of the washing plate to correspond to the projecting ribs, so that the washing plate is mounted to the support member using the plurality of projecting ribs and the plurality of grooves.

A vertical rotating shaft is provided between the washing shaft and the first rotary member to transmit a driving force from the washing shaft to the first rotary member. The vertical rotating shaft is mounted at an upper end thereof to a lower end of the first rotary member and is mounted at a lower end thereof to the washing shaft.

A plurality of spline ribs are provided around a lower portion of the vertical rotating shaft and an upper portion of the washing shaft, and a boss is provided at a junction of the vertical rotating shaft and the washing shaft, the boss being provided on an inner surface thereof with a plurality of spline grooves to engage with the plurality of spline ribs of the vertical rotating shaft and the washing shaft so that the vertical rotating shaft is connected to the washing shaft via the boss.

The vertical rotating shaft is rotatably supported by a housing. A bearing is interposed between the vertical rotating shaft and the housing. The housing is mounted to a bottom of a spin-drying tub in which the washing plate is set.

The upper end of the vertical rotating shaft and a lower end of the inclined rotating shaft are locked to the first rotary member by locking pins. The locking pins latitudinally penetrate the upper end of the vertical rotating shaft and the lower end of the inclined rotating shaft, respectively, so that the vertical rotating shaft and the inclined rotating shaft are locked to the first rotary member.

Further, a covering plate is provided along an outer edge of the washing plate to cover a gap formed between the washing plate and the spin-drying tub.

A holder is mounted at respective ends thereof to the support member and the housing, thus preventing the support member from being moved by a rotation of the second rotary member.

Further, a clutch guide is provided on a top of the support member so that the support member engages with or disengages from the clutch.

The clutch includes a clutch body, at least one clutch pin, a rotating plate, an actuation cam and a spring. The clutch body is mounted to the second rotary member. The at least one clutch pin is provided at a predetermined position of the clutch body so as to move into or to move out of the clutch body so that the clutch pin engages with or disengages from the clutch guide. The rotating plate is rotatably mounted to the clutch body. The actuation cam is fastened to the clutch pin to move the clutch pin inward by a rotation of the rotating plate. The spring is provided in the clutch body to bias the clutch pin outward. Thus, the clutch pin moves inward by the actuation cam when the rotating plate rotates in the first rotating direction, and disengages from the clutch guide, and the clutch pin moves outward by the spring when the rotating plate rotates in the second rotating direction, and engages with the clutch guide.

The clutch body is arranged along a diameter of the rotating plate, and the rotating plate is rotatably mounted to the clutch body by a setscrew loosely tightened to a center of the clutch body after passing through a center of the rotating plate.

At least one arc-shaped opening is formed at the rotating plate to extend from a position around an outer edge of the rotating plate to a position around the center of the rotating plate so that the actuation cam moves to the center of the rotating plate along an arc-shaped edge of the arc-shaped opening, thus moving the clutch pin inward, when the rotating plate rotates in the first direction.

A pin hole is bored from an end of the clutch body toward a center of the clutch body to receive the clutch pin in the clutch body so that the clutch pin moves inward or outward, and a cam hole is provided at a top of the clutch body to communicate with the pin hole so that the actuation cam fastens to the clutch pin and moves along the clutch body. A spring is provided in the pin hole to bias the clutch pin outward.

The actuation cam is loosely fitted over a setscrew tightened to an inside end of the clutch pin so that the actuation cam moves along the arc-shaped edge of the arc-shaped opening while rotating on an axis thereof.

Further, an actuation pin is provided on a lower surface of the rotating plate so as to downwardly project from the rotating plate, so that the projecting pin pushes the actuation pin when the inclined rotating shaft rotates in the first rotating direction, thus rotating the rotating plate.

A central angle of the arc-shaped opening may be greater than an angle formed between the actuation pin and the wobbling pin.

A projected length of the clutch pin extended from the clutch body by an elasticity of the spring may be determined according to a rotated angle of the actuation pin which is rotated by the projecting pin until the actuation pin is positioned near the wobbling pin.

The clutch guide includes a cylindrical part provided at a predetermined position which is spaced apart from an outer casing of the support member by a predetermined interval, and at least two connecting parts connecting the cylindrical part to the outer casing of the support member and arranged to face each other, with a pin insertion hole being provided at each of the at least two connecting parts so that the clutch pin projecting from the pin insertion hole inserts into and is stopped by the pin insertion hole.

Further, a base downwardly extends from a lower surface of the clutch body to mount the clutch body to the second rotary member.

BRIEF DESCRIPTION OF THE DRAWINGS

These and/or other aspects and advantages of the invention will become apparent and more readily appreciated from the following description of the preferred embodiment, taken in conjunction with the accompanying drawings of which:

FIGS. 8 to 11 illustrate an operation of the clutch included in the vertical shaft type washing machine illustrated in FIG. 2, in which:

FIG. 8 is a perspective view illustrating a part of the wobbling unit when the wobbling unit is positioned at the level position, in which a projecting pin of an inclined rotating shaft comes into contact with a leveling pin and a support member is held by the clutch;

FIG. 9 is a perspective view of the part of the wobbling unit, showing that the projecting pin of the inclined rotating shaft comes into contact with an actuation pin of the clutch at a position between the leveling pin and a wobbling pin and the support member is maintained at a position held by the clutch, when a position of the support member is changed from the level position to a wobbling position;

FIG. 10 is a perspective view illustrating the part of the wobbling unit, showing that the projecting pin of the inclined rotating shaft comes into contact with the wobbling pin just before the support member is released from the clutch, when the position of the support member is changed to the wobbling position; and FIG. 11 is a perspective view illustrating the part of the wobbling unit, showing that the projecting pin of the inclined rotating shaft pushes both the wobbling pin and the actuation pin of the clutch so as to completely release the support member from the clutch, thus completely changing the position of the support member to the wobbling position.

DETAILED DESCRIPTION OF THE PREFERRED EMBODIMENT

Figure 1:
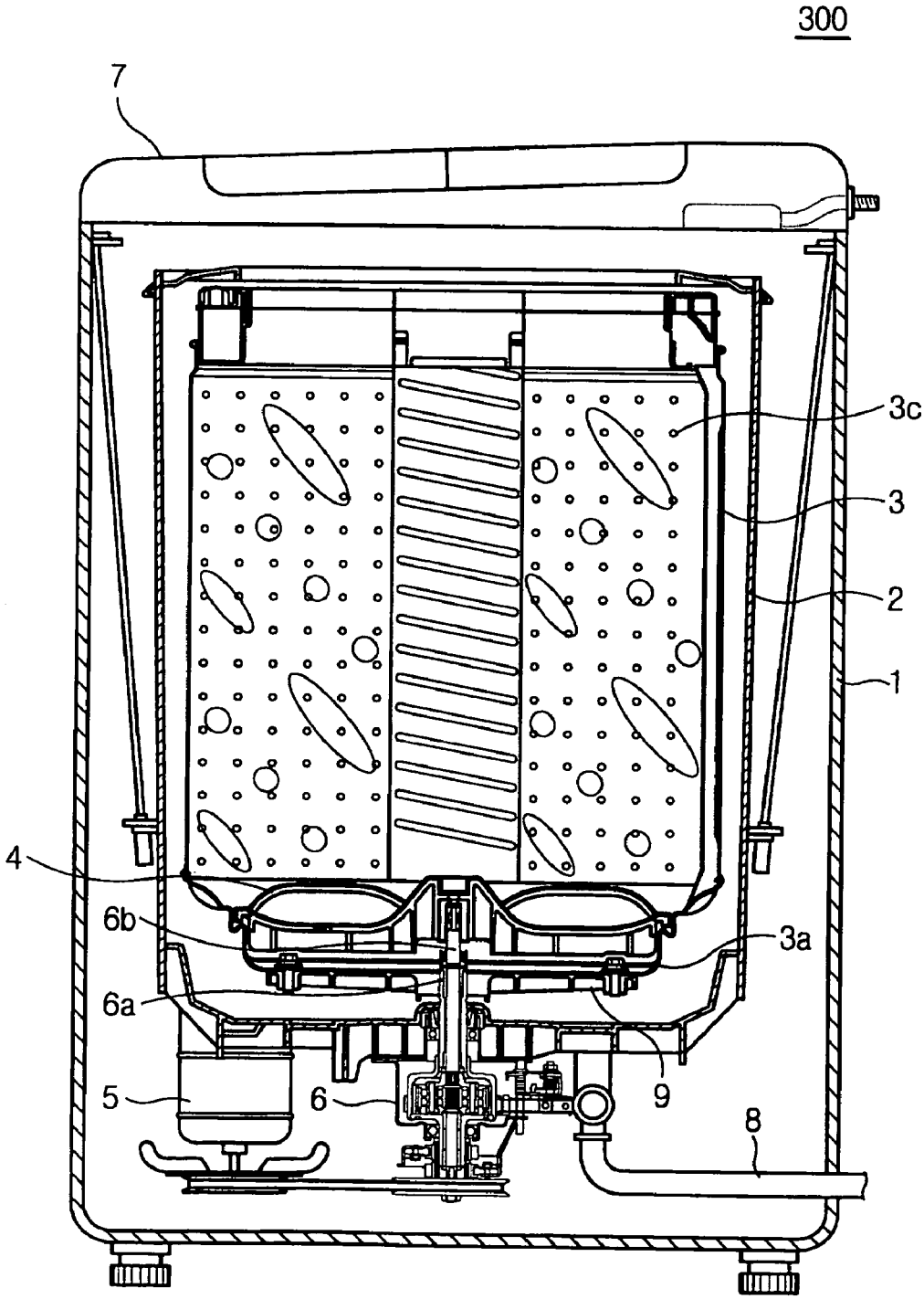
FIG. 1 (Prior Art)
FIG. 1 is a vertical sectional view illustrating an interior of a conventional vertical shaft type washing machine with a pulsator.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Elements of a washing machine according to the embodiment of the present invention which are common with elements of the conventional vertical shaft type washing machine illustrated in FIG. 1 will carry the same reference numerals.

Figure 2:
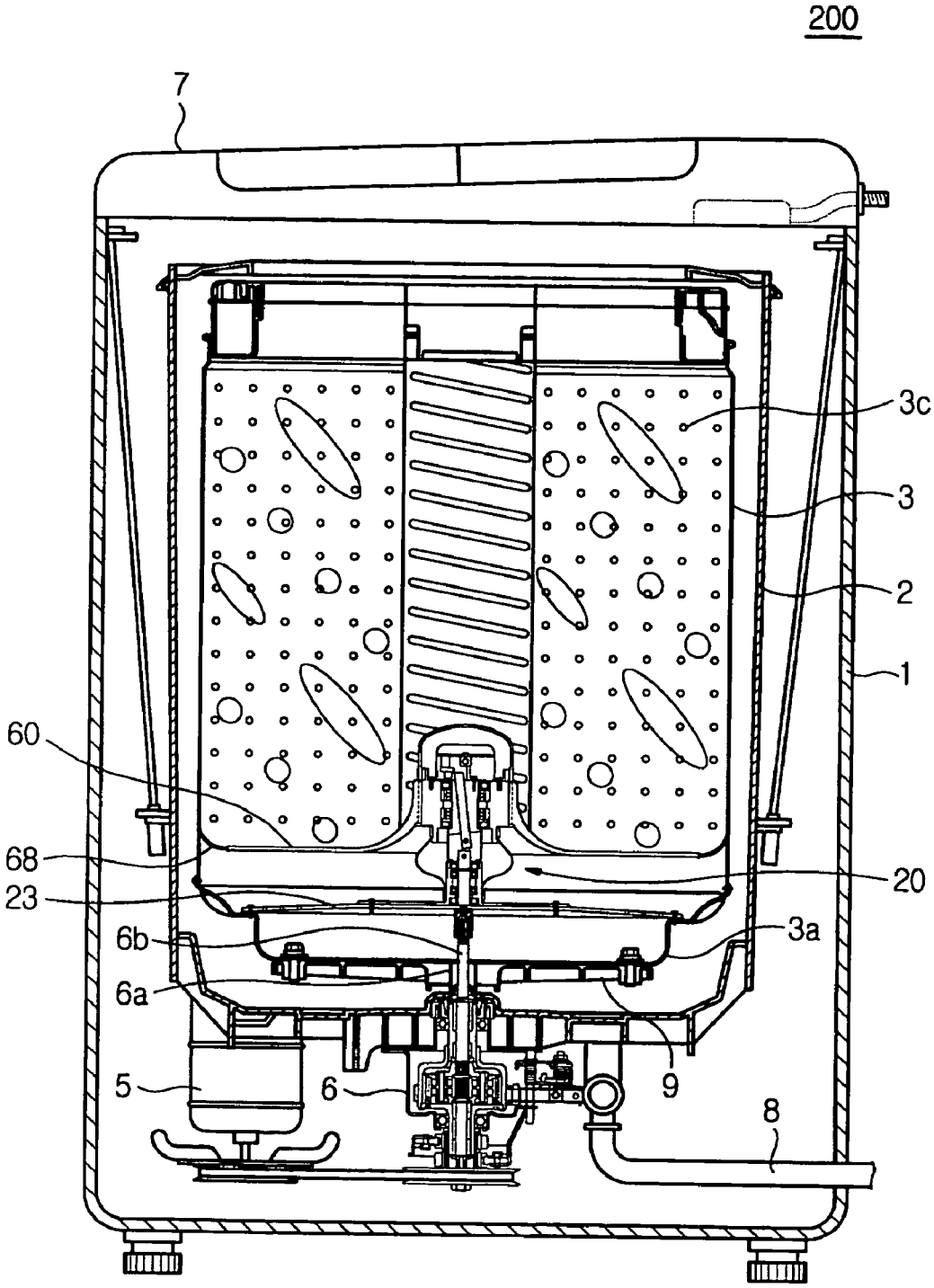
FIG. 2 is a vertical sectional view of a vertical shaft type washing machine with a wobbling unit, according to an embodiment of the present invention, with the wobbling unit being positioned at a level position.
Figure 3:
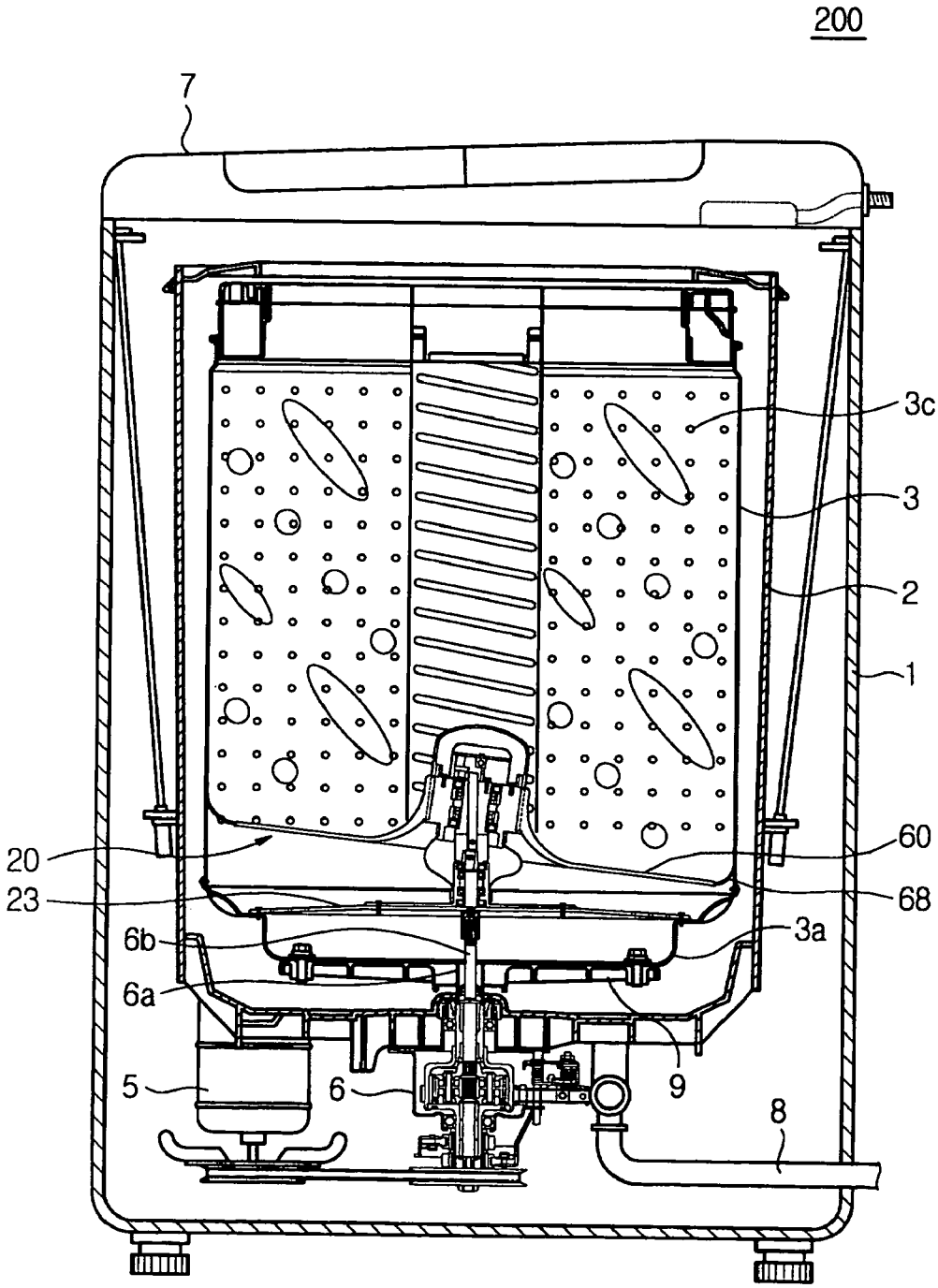
FIG. 3 is a vertical sectional view of the vertical shaft type washing machine with the wobbling unit illustrated in FIG. 2, with the wobbling unit being positioned at a wobbling position.

FIGS. 2 and 3 are vertical sectional views illustrating an interior of a vertical shaft type washing machine with a wobbling unit, according to an embodiment of the present invention, in which FIG. 2 illustrates the washing machine when the wobbling unit is positioned at a level position to perform a rinsing operation, and FIG. 3 illustrates the washing machine when the wobbling unit is positioned at a wobbling position to perform a washing operation. The terms 'wobbling position' and 'level position' herein may be defined as follows. The 'wobbling position' refers to a case where a washing plate of the washing machine is slantedly positioned by a wobbling unit so as to wobble in a vertical direction. The 'level position' refers to a case where the washing plate is horizontally positioned by the wobbling unit so as to be prevented from wobbling.

As illustrated in FIGS. 2 and 3, the washing machine according to an embodiment of the present invention includes a housing 1. A washing tub 2 is set in the housing 1. A cylindrical spin-drying tub 3 is concentrically set in the washing tub 2. The cylindrical spin-drying tub 3 is perforated on a sidewall thereof to have a large number of spin-drying perforations 3*c*. A drive motor 5 and a power transmission unit 6 are installed in a space between a bottom of the washing tub 2 and a bottom of the housing 1. The washing machine 200 includes a wobbling unit 20 which is installed in the cylindrical spin-drying tub 3.

A spin-drying shaft support unit 9 is mounted to an outer surface of a bottom plate 3*a* of the cylindrical spin-drying tub 3. A spin-drying shaft 6*a* of the power transmission unit 6 is mounted to a center of the spin-drying shaft support unit 9 to rotate the cylindrical spin-drying tub 3 at a spin-drying operation. A washing shaft 6*b* is provided in the spin-drying shaft 6*a* such that an upper end of the washing shaft 6*b* slightly and outwardly extends from an end of the spin-drying shaft 6*a* so that the washing shaft 6*b* is connected to the wobbling unit 20.

The wobbling unit 20 is installed inside the cylindrical spin-drying tub 3 at a position adjacent to a bottom of the cylindrical spin-drying tub 3. When performing the spin-drying operation, as illustrated in FIG. 2, the wobbling unit 20 is positioned at the level position to rotate along with the cylindrical spin-drying tub 3, thus spin-drying laundry. When performing the washing operation, as illustrated in FIG. 3, the wobbling unit 20 is positioned at the wobbling position to wobble the laundry in a vertical direction, thus washing the laundry.

Figure 4:
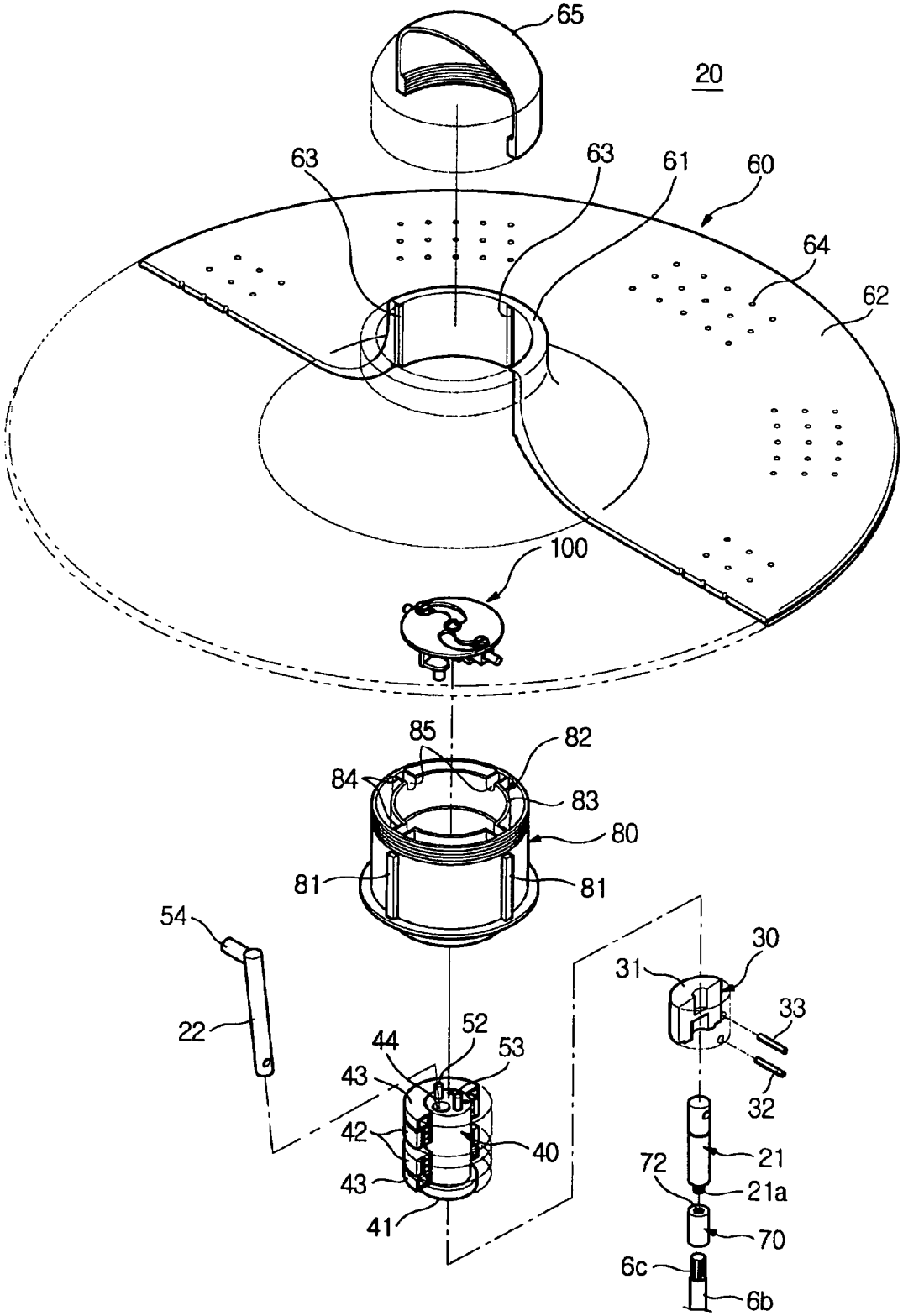
FIG. 4 is an exploded perspective view of the wobbling unit included in the vertical shaft type washing machine illustrated in FIG. 2.

FIG. 4 is an exploded perspective view of the wobbling unit illustrated in FIG. 2, to show elements thereof. As illustrated in FIG. 4, the wobbling unit 20 includes a vertical rotating shaft 21 which is connected to the washing shaft 6*b*. An inclined rotating shaft 22 is inclinedly arranged at a predetermined position above the vertical rotating shaft 21. The wobbling unit 20 includes a first rotary member 30 to integrally rotate the vertical rotating shaft 21 and the inclined rotating shaft 22. A second rotary member 40 rotatably receives the inclined rotating shaft 22. A lower end of the second rotary member 40 is positioned on an upper end of the first rotary member 30. A leveling pin 52 and a wobbling pin 53 are provided on an upper end of the second rotary member 40 so that a position of the wobbling unit 20 is changed from the wobbling position to the level position or from the level position to the wobbling position. A support member 80 and a washing plate 60 are inclinedly or horizontally arranged as the position of the wobbling unit 20 is changed to the wobbling position or the level position. The wobbling unit 20 includes a clutch 100. The clutch 100 is mounted to the upper end of the second rotary member 40 so that the support member 80 engages with or disengages from the second rotary member 40 at the level position or the wobbling position, respectively.

The vertical rotating shaft 21 is connected at a lower portion thereof to an upper end of the washing shaft 6*b* of the power transmission unit 6 via a tubular boss 70. Further, the vertical rotating shaft 21 is mounted at an upper end thereof to a lower portion of the first rotary member 30 by a locking pin 32 which latitudinally penetrates the vertical rotating shaft 21 and the first rotary member 30. Thus, when the washing shaft 6*b* rotates, the vertical rotating shaft 21 rotates along with the first rotary member 30.

To connect the vertical rotating shaft 21 to the washing shaft 6*b*, spline ribs 21*a* and 6*c* are provided on the lower end of the vertical rotating shaft 21 and the upper end of the washing shaft 6*b*. Further, spline grooves 72 are provided on an inner surface of the tubular boss 70 to engage with the spline ribs 21*a* and 6*c*. Thus, the lower end of the vertical rotating shaft 21 and the upper end of the washing shaft 6*b* engage with the upper end and the lower end of the tubular boss 70, respectively, using the spline ribs 21*a* and 6*c* and the spline grooves 72. An annular step 71 is horizontally provided around a center portion on an inner surface of the tubular boss 70 to separate the washing shaft 6*b* from the vertical rotating shaft 21 (see FIG. 6).

Figure 6:
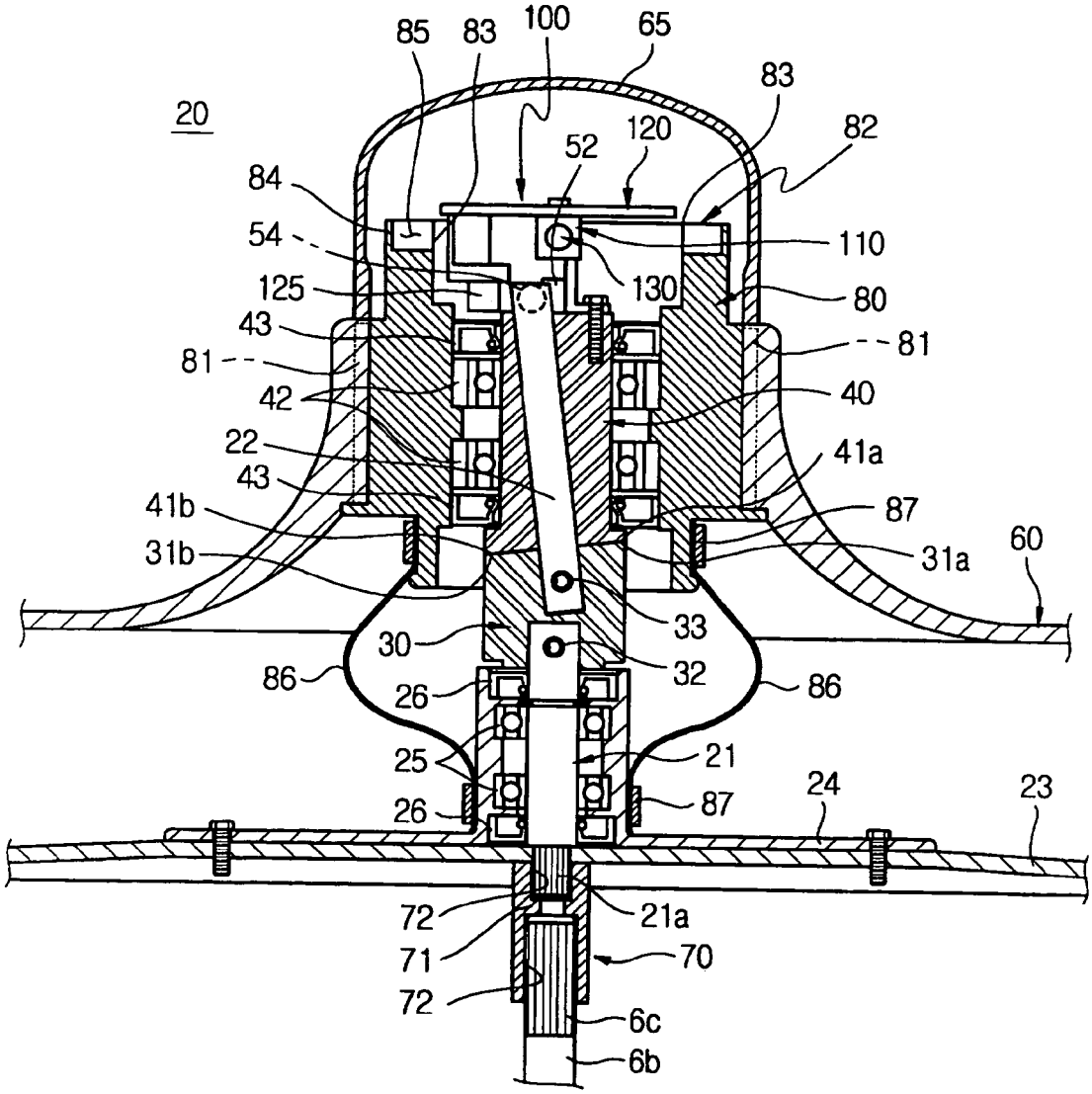
FIG. 6 is a vertical sectional view of the wobbling unit included in the vertical shaft type washing machine illustrated in FIG. 2, with the wobbling unit being positioned at the level position.

Although not illustrated in FIG. 4, the vertical rotating shaft 21 is rotatably supported by a base 23 and a housing 24 (see FIG. 6). The base 23 and the housing 24 are mounted to the bottom plate 3*a* of the cylindrical spin-drying tub 3, and will be later described in detail with reference to FIG. 6.

The first rotary member 30 is inclined at the upper end thereof at a predetermined angle to form a first inclined surface 31. Further, the second rotary member 40 is inclined at the lower end thereof at a common angle as that of the first inclined surface 31 to form a second inclined surface 41. The second inclined surface 41 of the second rotary member 40 is positioned on the first inclined surface 31 of the first rotary member 30. A wobbling angle of the washing plate 60 which wobbles in the vertical direction is determined according to an inclination angle of the first and second inclined surfaces 31 and 41. The first and second inclined surfaces 31 and 41 may have an inclination angle of 5° to 20°.

Further, according to a state where the second inclined surface 41 provided on the lower end of the second rotary member 40 is positioned on the first inclined surface 31 provided on the upper end of the first rotary member 30, a position of the washing plate 60 is changed to the level position or the wobbling position. At the level position, the washing plate 60 is horizontally positioned to perform the spin-drying operation, as illustrated in FIG. 2. At the wobbling position, the washing plate 60 is inclinedly positioned to perform the washing operation as illustrated in FIG. 3. The operation of changing the position of the washing plate between the level position and the wobbling position will be described in the following in detail.

The inclined rotating shaft 22 is rotatably provided in the second rotary member 40 so as to incline with respect to the vertical rotating shaft 21 at the common angle as the inclination angle of the first and second inclined surfaces 31 and 41 (see FIG. 6). The inclined rotating shaft 22 is locked at a lower end thereof to the upper portion of the first rotary member 30 by a second locking pin 33 which latitudinally penetrates the inclined rotating shaft 22 and the first rotary member 30, thus rotating along with the first rotary member 30. That is, the inclined rotating shaft 22 and the vertical rotating shaft 21 are locked to the upper and lower portions of the first rotary member 30, respectively. Thus, when the vertical rotating shaft 21 rotates, the first rotary member 30 and the inclined rotating shaft 22 are integrally rotated along with the vertical rotating shaft 21.

The inclined rotating shaft 22 fits into an axial bore 44 which is formed in the second rotary member 40. In this case, a slight gap is formed between the inclined rotating shaft 22 and the axial bore 44 so that the inclined rotating shaft 22 is rotatable in the second rotary member 40.

The support member 80 fits over the second rotary member 40, and operates to rotatably support the second rotary member 40 and to wobble the washing plate 60 in the vertical direction without rotating the washing plate 60 at the washing operation. Two bearings 42 sealed at upper and lower portions thereof by two oil seals 43 are interposed between the support member 80 and the second rotary member 40 so as to rotatably support the second rotary member 40.

The upper surface of the second rotary member 40 is a flat surface (i.e., not inclined), which is different from the second inclined surface 41 provided on the lower end of the second rotary member 40. The leveling pin 52 and the wobbling pin 53 are provided at opposite positions on the upper surface of the second rotary member 40, and upwardly project from the upper surface of the second rotary member 40. A projecting pin 54 horizontally extends from the upper portion of the inclined rotating shaft 22.

The washing plate 60 includes a tubular central part 61 and a wing part 62. In this case, the central part 61 fits over the support member 80. The wing part 62, on which laundry is placed, downwardly and integrally extends from the tubular central part 61. The wing part 62 is provided with a plurality of perforations 64, thus allowing wash water to flow in the vertical direction.

Further, as illustrated in FIG. 2, a cover plate 68U, which is made of an elastic material, is provided along an outer edge of the wing part 62 of the washing plate 60 to cover a gap formed between the washing plate 60 and the cylindrical spin-drying tub 3.

To mount the washing plate 60 to the support member 80, a plurality of projecting ribs 81 vertically project from an outer surface of the support member 80 at regular intervals, and a plurality of grooves 63 are provided on an inner surface of the central part 61 to engage with the corresponding projecting ribs 81. Further, a cover 65 having internal threads is provided at an upper portion of the washing plate 60, and is tightened to external threads of the support member 80 to cover an open upper portion of the support member 80, thus preventing the laundry from coming into contact with the support member 80.

Further, a clutch guide 82 is provided at the support member 80 so that the clutch engages with or disengages from the support member 80. The clutch guide 82 includes an inner cylindrical part 83 and a plurality of connecting parts 84. The cylindrical part 83 is provided in the support member 80 so as to be spaced apart from an outer casing of the support member 80 by a predetermined interval. The plurality of connecting parts 84 are arranged spaced apart from each other at angular intervals of 90°, and connect the inner cylindrical part 83 to the outer casing of the support member 80. A pin insertion hole 85 is provided at each of the connecting parts 84 so as to be upwardly open, so that two clutch pins 130 (see FIG. 5) are inserted into and stopped by two of the pin insertion holes 85, thus holding the support member 80.

Figure 5:
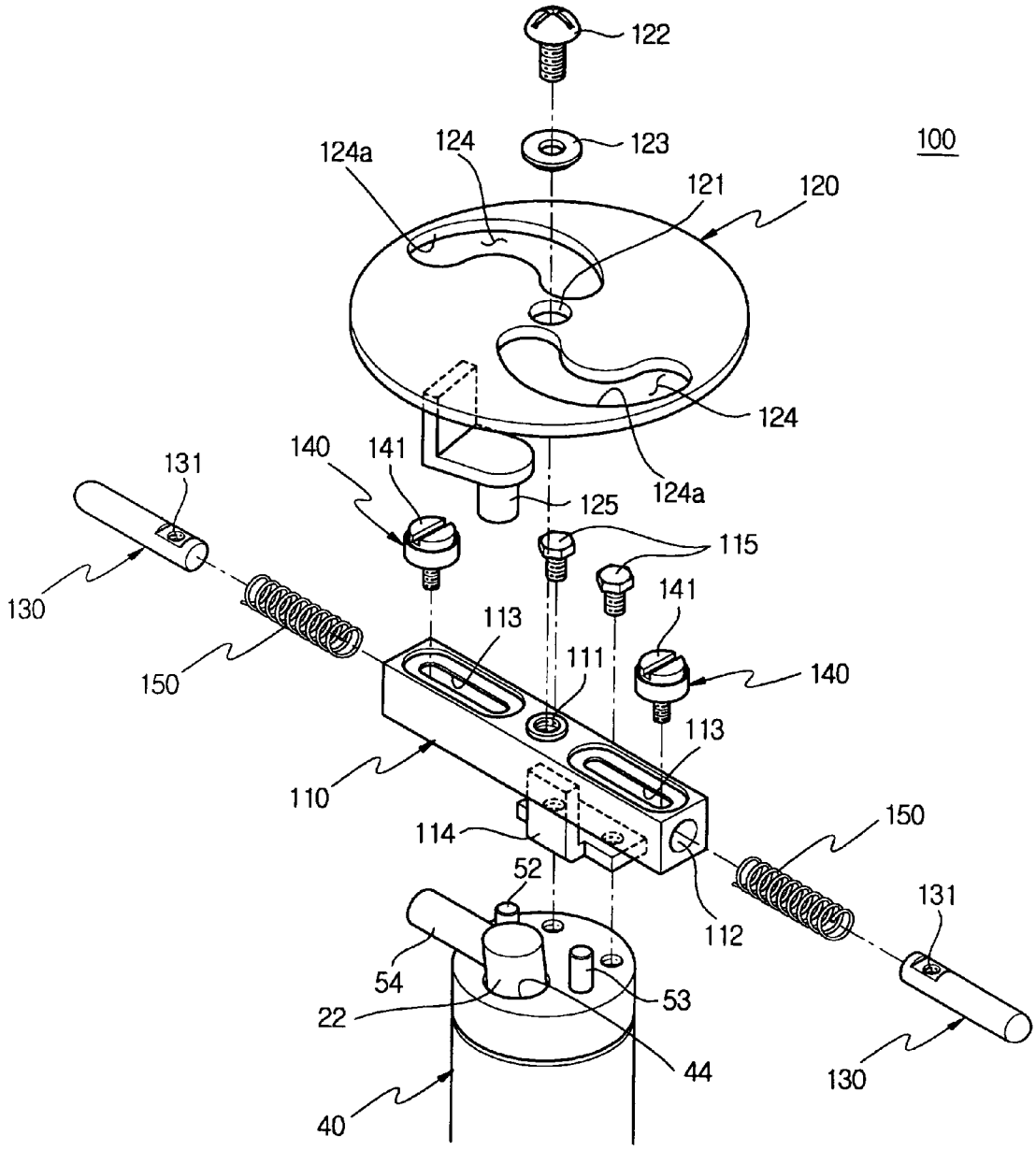
FIG. 5 is an exploded perspective view of a clutch illustrated in FIG. 4.

FIG. 5 is an exploded perspective view of the clutch 100. As illustrated in FIG. 5, the clutch 100 includes a clutch body 110 which is mounted to a top of the second rotary member 40. A rotating plate 120 is rotatably mounted to the clutch body 110. The clutch 100 further includes the two clutch pins 130. As the two clutch pins 130 move out of or move into the clutch body 110, the two clutch pins 130 engage with or disengage from the clutch guide 82 which is provided at the support member 80, thus accomplishing a clutching operation. An actuation cam 140 is arranged at the clutch body 110 to fasten to each of the clutch pins 130, and operates to move each of the clutch pins 130 inward by a rotation of the rotating plate 120. Springs 150 are provided in the clutch body 110, respectively, to bias each of the clutch pins 130 outward.

The clutch body 110 has a length corresponding to a diameter of the rotating plate 120 so as to be arranged along the diameter of the rotating plate 120 having a disc shape. A setscrew 122 is loosely tightened to a hole 111 which is formed at a center of the clutch body 110 after passing through a center hole 121 of the rotating plate 120, thus allowing the rotating plate 120 to rotate with respect to the clutch body 110. A bush 123 is provided between the center hole 121 and a head of the setscrew 122 so that the rotating plate 120 smoothly rotates with respect to the clutch body 110.

Two opposing arc-shaped openings 124 are formed in the rotating plate 120 to extend from positions around an outer edge of a rotating plate 120 to positions around a center of the rotating plate 120 so that each of the actuation cams 140 is arranged to contact with an arc-shaped edge 124*a* of each of the arc-shaped openings 124.

An actuation pin 125 is provided on a lower surface of the rotating plate 120 so as to downwardly project from the rotating plate 120. When the clutch body 110 is mounted to the top of the second rotary member 40, the actuation pin 125 is provided between the leveling pin 52 and the wobbling pin 53 so as to be positioned nearer to the wobbling pin 53. When the inclined rotating shaft 22 rotates in a first rotating direction (i.e., counterclockwise); a projecting pin 54 of the inclined rotating shaft 22 comes into contact with the actuation pin 125 and rotates the actuation pin 125, thus rotating the rotating plate 120 counterclockwise.

Two pin holes 112 are longitudinally bored from opposite ends of the clutch body 110 toward a center of the clutch body 110 to receive the respective clutch pins 130 in the clutch body 110 so that the respective clutch pins 130 move into and move out of the clutch body 110. Further, two cam holes 113 are provided at the top of the clutch body 110 to communicate with the pin holes 112 so that the actuation cams 140 fastened to the respective clutch pins 130 move along the clutch body 110.

Each of the springs 150 is supported at an end thereof by an inside end of each of the pins hole 112 while being supported at another end thereof by an inside end of each of the clutch pins 130, thus biasing each of the clutch pins 130 outward.

Each of the actuation cams 140 has a ring shape, and is fastened to the respective clutch pins 130 by a second setscrew 141, which passes through a corresponding actuation cam 140 and is tightened to a corresponding screw hole 131 formed at an upper surface of each of the clutch pins 130. In this case, each of the actuation cams 140 loosely fits over a respective second setscrew 141 so that each of the actuation cams 140 rotates with respect to the respective second setscrew 141, and thereby each of the actuation cams 140 moves along the arc-shaped edge 124*a* of a respective one of the arc-shaped openings 124 while rotating on an axis thereof.

Each of the clutch pins 130 having a longitudinal rod shape is received in the respective pin hole 112 such that each of the clutch pins 130 fastens to the respective actuation cam 140 which moves along the respective cam hole 113 and the respective arc-shaped opening 124 of the rotating plate 120. When each of the springs 150 is compressed to a maximum compression, only an end of each of the clutch pins 130 slightly and outwardly projects from the corresponding pin hole 112, so that the clutch pin 130 is removed from the corresponding pin insertion hole 85 of the clutch guide 82. When each of the springs 150 is released, each of the clutch pins 130 further and outwardly projects from the pin hole 112, thus being inserted into the corresponding pin insertion hole 85.

The rotating plate 120, the clutch pins 130, the actuation cams 140 and the springs 150 are mounted to the clutch body 110. To mount the clutch body 110 to the top of the second rotary member 40 using setscrews 115, a base 114 is provided at a lower portion of the clutch body 110 so as to downwardly extend from the clutch body 110. Since the clutch body 110 is screwed to the second rotary member 40, the clutch body 110 rotates along with the second rotary member 40.

In this case, a central angle of each of the arc-shaped openings 124 is set slightly larger than an angle between the actuation pin 125, downwardly extending from the lower surface of the rotating plate 120, and the wobbling pin 53, upwardly projecting from the second rotary member 40, and the center hole 121 provided in the rotating plate 120. A projected length of each of the clutch pins 130, which outwardly projects from the corresponding pin holes 112 of the clutch body 110 by elasticity of the spring respective 150, is determined in accordance with a rotating angle of the actuation pin 125 such that the projected clutch pin is retracted into the corresponding pin hole 112 when the actuation pin 125 rotates by the projecting pin 54 so as to be placed around the wobbling pin 53.

Thus, a moving distance of each of the actuation cams 140, which inwardly moves along the respective cam holes 113 by the rotating plate 120 while the actuation pin 125 is in contact with the projecting pin 54 and rotates to a position near the wobbling pin 53, is similar to the projected length of each clutch pin 130 which outwardly projects from the end of the clutch body 110 by the respective spring 150. Thus, when the actuation pin 125 is pushed and rotates by the projecting pin 54 and is positioned near the wobbling pin 53, each of the clutch pins 130 slightly projects from the corresponding pin hole 112 so as to disengage from the corresponding pin insertion hole 85 of the clutch guide 82.

Figure 7:
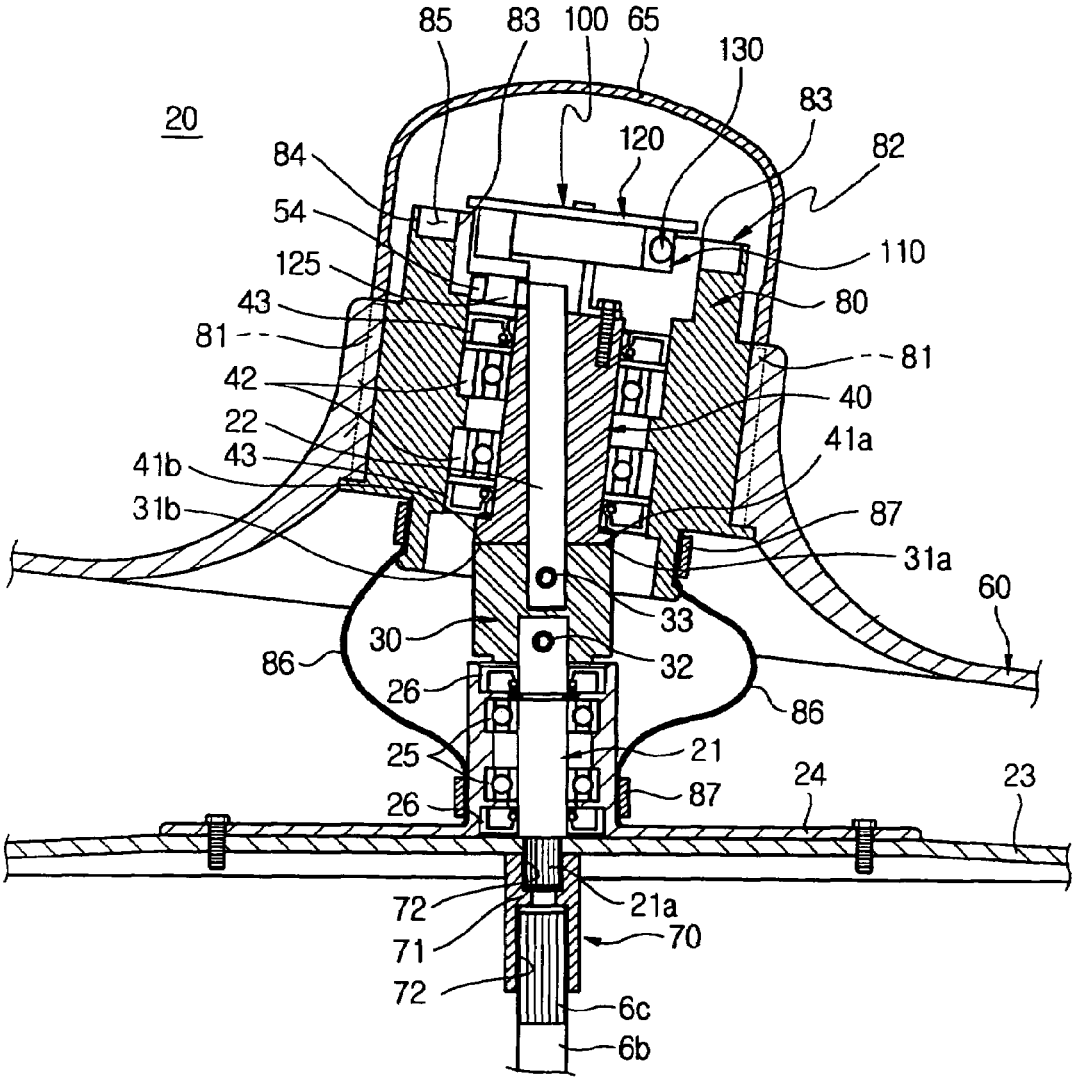
FIG. 7 is a vertical sectional view of the wobbling unit included in the vertical shaft type washing machine illustrated in FIG. 2, with the wobbling unit being positioned at the wobbling position.
Figure 8:
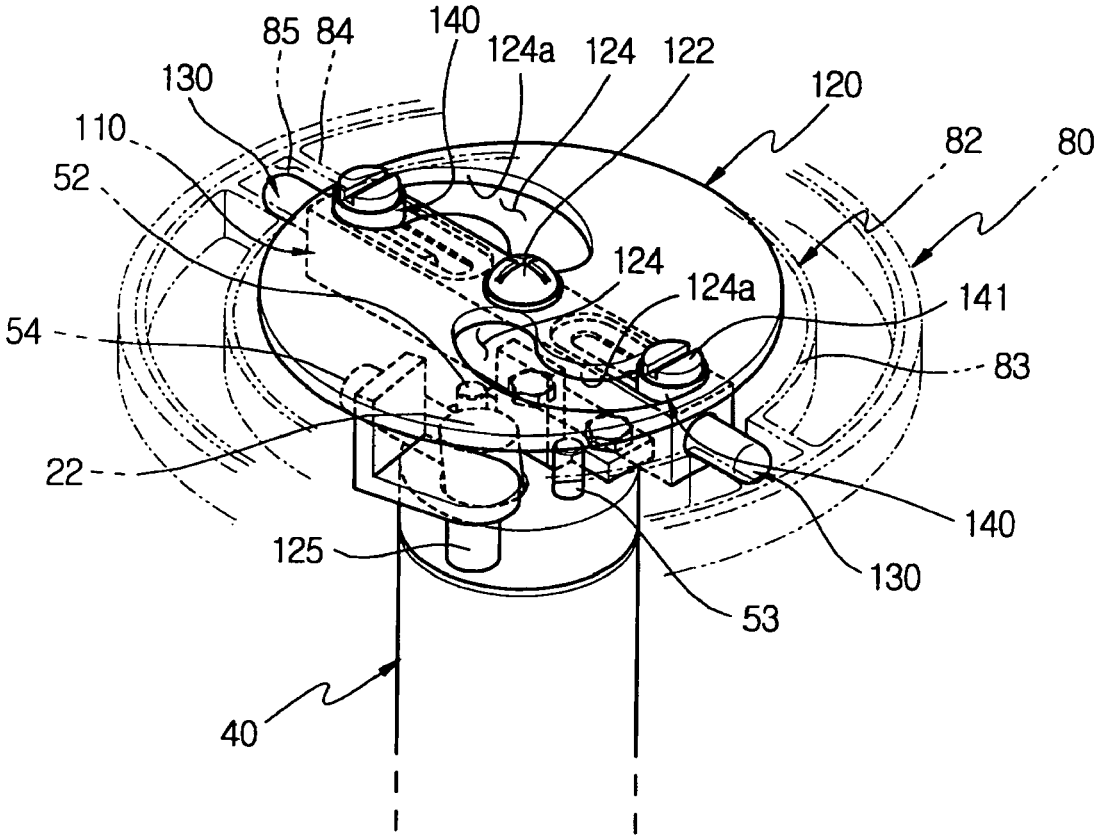
Figure 9:
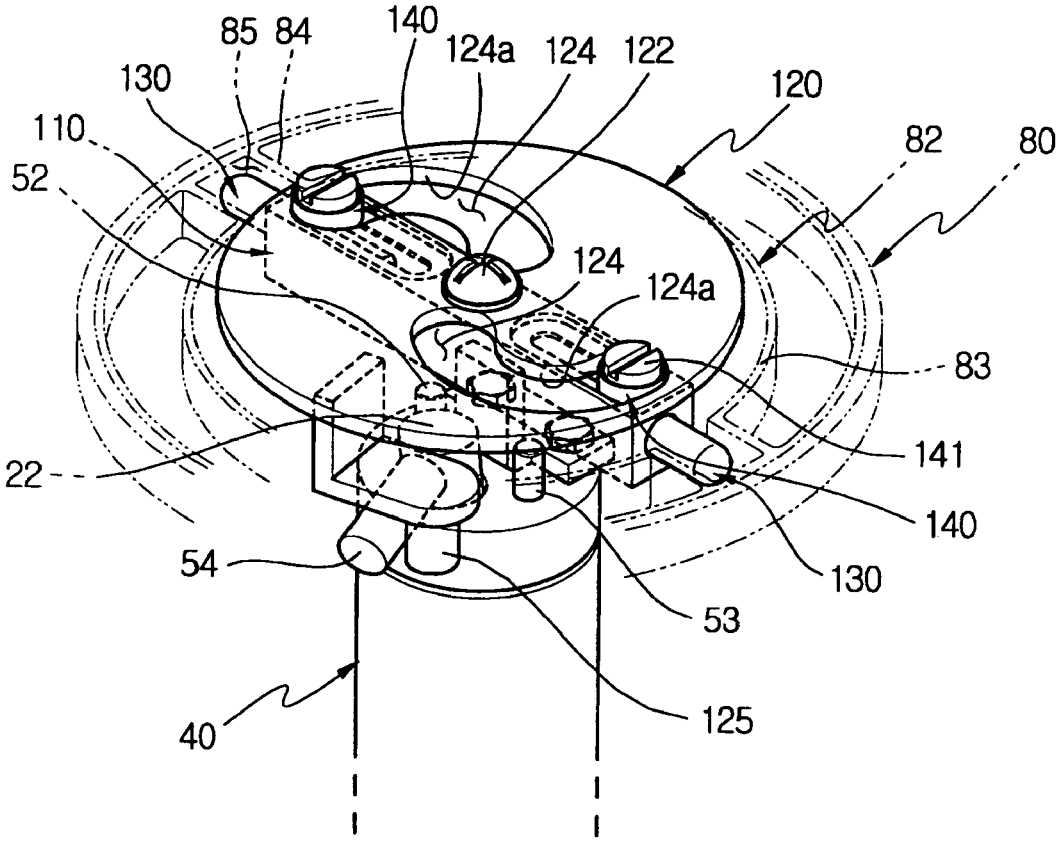
Figure 10:
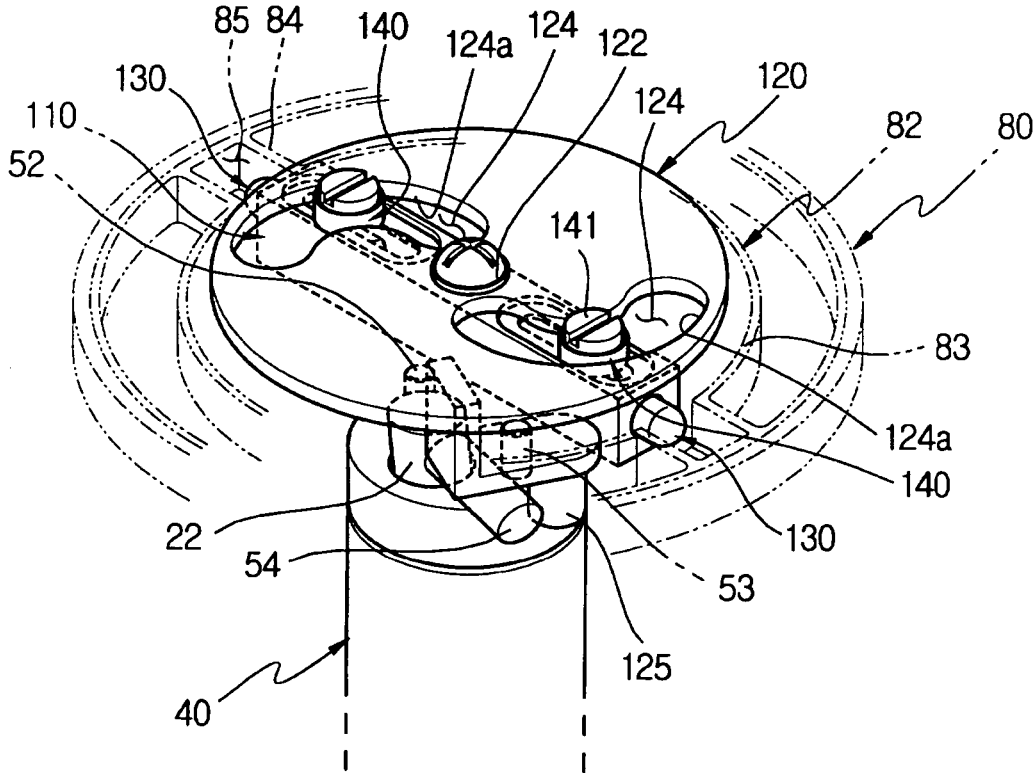
Figure 11:
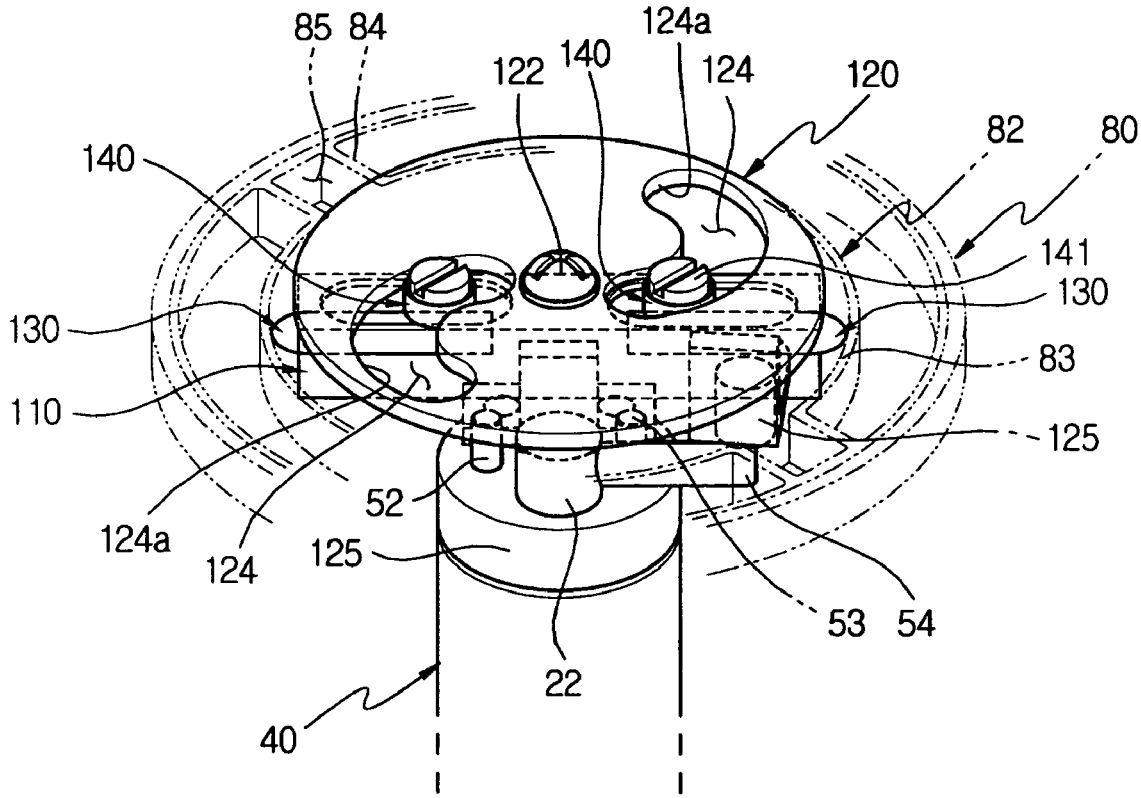

FIG. 6 is a vertical sectional view of the wobbling unit included in the vertical shaft type washing machine illustrated in FIG. 2, with the wobbling unit being positioned at the level position. FIG. 7 is a vertical sectional view of the wobbling unit included in the vertical shaft type washing machine illustrated in FIG. 2, with the wobbling unit being positioned at the wobbling position. FIGS. 8 to 11 illustrate an operation of the clutch included in the vertical shaft type washing machine,] according to an embodiment of the present invention] illustrated in FIG. 3. In this case, FIG. 8 is a perspective view illustrating a part of the wobbling unit when the wobbling unit is positioned at the level position, in which a projecting pin of an inclined rotating shaft comes into contact with a leveling pin and a support member is held by the clutch. FIG. 9 is a perspective view of the part of the wobbling unit, showing that the projecting pin of the inclined rotating shaft comes into contact with an actuation pin of the clutch at a position between the leveling pin and a wobbling pin and the support member is held by the clutch, when a position of the support member is changing from the level position to a wobbling position. FIG. 10 is a perspective view illustrating the part of the wobbling unit, showing that the projecting pin of the inclined rotating shaft comes into contact with the wobbling pin just before the support member is released from the clutch, when the position of the support member is changed to the wobbling position. FIG. 11 is a perspective view illustrating the part of the wobbling unit, showing that the projecting pin of the inclined rotating shaft pushes both the wobbling pin and the actuation pin of the clutch so as to completely release the support member from the clutch, thus completely changing the position of the support member to the wobbling position.

As illustrated in FIGS. 6 and 7, the vertical rotating shaft 21 is rotatably supported in the housing 24 by bearings 25. Oil seals 26 are provided on upper and lower portions of the bearings 25, respectively, to seal the bearings 25, thus preventing impurities from entering the bearings 25. The housing 24 is mounted to the base 23 having a disc-shape using bolts. The base 23 is mounted to an upper portion of the bottom plate 3*a* of the cylindrical spin-drying tub 3 using bolts and is provided with a plurality of spin-drying perforations 3*c* (see FIG. 2). The vertical rotating shaft 21 is connected to the washing shaft 6*b* using the spline rib 21*a* provided on the lower end of the vertical rotating shaft 21 and the spline rib 6*c* provided on the upper end of the washing shaft 6*b*, so that the vertical rotating shaft 21 rotates along with the washing shaft 6*b*.

The inclined rotating shaft 22 passes through the second rotary member 40 so as to incline at a predetermined angle with respect to the second rotary member 40. Upper and lower ends of the inclined rotating shaft 22 outwardly extend from the second rotary member 40. Further, a predetermined gap is formed between the inclined rotating shaft 22 and the second rotary member 40, thus allowing the inclined rotating shaft 22 to rotate with respect to the second rotary member 40.

The upper end of the vertical rotating shaft 21 and the lower end of the inclined rotating shaft 22 are locked to the first rotary member 30 by the locking pins 32 and 33, so that the vertical rotating shaft 21 and the inclined rotating shaft 22 rotate along with the first rotary member 30. Further, the second rotary member 40 is rotatably set in the support member 80 by the bearings 42 and the oil seals 43. The washing plate 60 mounts to the outer surface of the support member 80.

As illustrated in FIGS. 8 to 11, the leveling pin 52 and the wobbling pin 53 upwardly project from the upper surface of the second rotary member 40, and are spaced apart from each other to form an angle of 180° with each other. The projecting pin 54 horizontally extends from the upper portion of the inclined rotating shaft 22. Thus, when the inclined rotating shaft 22 rotates in the second rotating direction or in the first rotating direction (i.e., clockwise or counterclockwise) the projecting pin 54 comes into contact with the leveling pin 52 or the wobbling pin 53, so the second rotary member 40 rotates along with the inclined rotating shaft 22. Further, the actuation pin 125 downwardly extending from the rotating plate 120 of the clutch 100 is arranged between the projecting pin 54 and the wobbling pin 53. Thus, when the projecting pin 54 rotates counterclockwise, the projecting pin 54 pushes the actuation pin 125, so the rotating plate 120 rotates counterclockwise.

Further, as illustrated in FIG. 8, when the inclined rotating shaft 22 rotates clockwise, the projecting pin 54 comes into contact with the leveling pin 52. As illustrated in FIG. 6, an upper end 31*a* of the first inclined surface 31 of the first rotary member 30 comes into contact with an upper end 41*a* of the second inclined surface 41 of the second rotary member 40, while a lower end 31*b* of the first inclined surface 31 comes into contact with a lower end 41*b* of the second inclined surface 41, so the upper surfaces of the second rotary member 40 and the support member 80 are horizontally arranged. Thus, the washing plate 60 mounted to the support member 80 is horizontally arranged, so the position of the wobbling unit 20 is changed to the level position to perform the spin-drying operated.

In this case, the second rotary member 40 is rotatably received in the support member 80 by the bearings 42. A holder 86 is mounted at opposite ends thereof to the support member 80 and the housing 24, respectively, thus preventing the support member 80 from moving by a rotation of the second rotary member 40. The holder 86 has a structure which is flexible in the vertical direction by a wobbling operation of the washing plate 60. Further, the holder 86 is mounted to the support member 80 and the housing 24 using wires 87 which wind around upper and lower ends of the holder 86.

As illustrated in FIGS. 9 to 11, when the inclined rotating shaft 22 rotates counterclockwise, the projecting pin 54 pushes the actuation pin 125 of the rotating plate 120 in the same direction, and subsequently, the projecting pin 54 reaches a position where the projecting pin 54 comes into contact with the wobbling pin 53. Further, as illustrated in FIG. 7, the upper end 31*a* of the first inclined surface 31 of the first rotary member 30 comes into contact with the lower end 41*b* of the second inclined surface 41 of the second rotary member 40, while the lower end 31*b* of the first inclined surface 31 comes into contact with the upper end 41*a* of the second inclined surface 41. Thus, the first and second inclined surfaces 31 and 41 are horizontally positioned, whereas the upper surfaces of the second rotary member 40 and the support member 80 are inclinedly positioned. In this case, the washing plate 60 mounted to the support member 80 is inclinedly positioned, so the position of the wobbling unit 20 is changed to the wobbling position to perform the washing operation.

The operation of the vertical shaft type washing machine with the wobbling unit will be described in the following.

When the washing machine is operated after putting laundry into the cylindrical spin-drying tub 3, water is supplied to the washing tub 2 and simultaneously the wobbling unit 20 is operated by the drive motor 5 and the power transmission unit 6.

That is, when the vertical rotating shaft 21 rotates in the second rotating direction, (i.e., clockwise) along with the washing shaft 6*b* so that the cylindrical spin-drying tub 3 rotates at a low speed to soak the laundry using the water supplied to the washing tub 2, the inclined rotating shaft 22 connected to the vertical rotating shaft 21 via the first rotary member 30 is also rotated. When the inclined rotating shaft 22 rotates clockwise and the projecting pin 54 comes into contact with the leveling pin 52 as illustrated in FIG. 8, the upper end 31*a* of the first inclined surface 31 of the first rotary member 30 comes into contact with the upper end 41*a* of the second inclined surface 41 of the second rotary member 40 while the lower end 31*b* of the first inclined surface 31 comes into contact with the lower end 41*b* of the second inclined surface 41, as illustrated in FIG. 6. Thus, the second rotary member 40 rotates as the upper surface thereof is horizontally arranged, so the positions of the support member 80 and the washing plate 60 are changed to the level position where the support member 80 and the washing plate 60 are horizontally arranged.

Further, when the projecting pin 54 rotates clockwise, the projecting pin 54 does not rotate the rotating plate 120 of the clutch 100. Thus, the clutch pins 130 outwardly project from the corresponding pin holes 112 by the predetermined length by the elasticity of the corresponding springs 150 which are provided in the corresponding pin holes 112, so that the clutch pins 130 insert into and are stopped by the corresponding pin insertion holes 85 of the clutch guide 82.

Thus, when the inclined rotating shaft 22 continues rotating at a low speed at the level position, the second rotary member 40 rotates along with the inclined rotating shaft 22 as the upper surface of the second rotary member 40 is horizontally arranged, and the support member 80 and the washing plate 60 rotate along with the second rotary member 40 at a low speed while being prevented from wobbling in the vertical direction by the clutch 100, thus allowing laundry placed on the washing plate 60 to be uniformly wetted by the water supplied to the washing tub 2.

Next, when the spin-drying shaft 6*a* is not moved and the washing shaft 6*b* rotates in the first rotating direction, that is, counterclockwise, at a predetermined angle, the vertical rotating shaft 21, the first rotary member 30, and the inclined rotating shaft 22 integrally rotate counterclockwise. Further, the projecting pin 54 of the inclined rotating shaft 22 comes into contact with the actuation pin 125 of the rotating plate 120, as illustrated in FIG. 9.

When the projecting pin 54 further rotates from the state illustrated in FIG. 9, the actuation pin 125 also rotates by the projecting pin 54, so the rotating plate 120 rotates counterclockwise. Further, each of the actuation cams 140 moves along the arc-shaped edge 124*a* of the arc-shaped opening 124 toward the center of the rotating plate 120 while rotating on an axis of the actuation cam 140. By such a movement of each of the actuation cams 140, each of the actuation cams 140 moves to an inside end of the respective cam holes 113 of the clutch body 110, so the respective clutch pin 130 fastened to the actuation cam 140 moves inward in the respective pin hole 112 by a predetermined distance while remaining inserted in the respective pin insertion hole 85.

Such a movement of each of the clutch pins 130 continues until the projecting pin 54 comes into contact with the wobbling pin 53, as illustrated in FIG. 10. In such a state, the support member 80 and the washing plate 60 are held by the clutch pins 130 until the inclined rotating shaft 22 comes into contact with the wobbling pin 53, so as not to hinder the rotation of the inclined rotating shaft 22. Thus, the clutch body 110 of the clutch 100 in the above state stops, and only the rotating plate 120 rotates along with the projecting pin 54.

When the projecting pin 54 further rotates along with the wobbling pin 53 and the actuation pin 125 counterclockwise from the state illustrated in FIG. 10, the clutch pins 130 are completely removed from the pin insertion holes 85 as illustrated in FIG. 11, so the support member 80 releases from the clutch 100. Thus, the clutch 100 rotates along the cylindrical part 83 of the clutch guide 82 counterclockwise, together with the second rotary member 40.

That is, the support member 80 and the washing plate 60 are held by the clutch pins 130 provided at the clutch body 110 so that the support member 80 and the washing plate 60 are not moved until the projecting pin 54 of the inclined rotating shaft 22 comes into contact with the wobbling pin 53, so only the rotating plate 120 rotates. Thus, although a large quantity of the laundry is placed on the washing plate 60, the projecting pin 54 smoothly rotates at an angle where the projecting pin 54 reaches a position of the wobbling pin 53, thus allowing the second rotary member 40 and the first rotary member 30 to rotate while maintaining a wobbling angle.

Further, when the projecting pin 54 comes into contact with the wobbling pin 53 as illustrated in FIG. 10, the upper end 31*a* of the first inclined surface 31 of the first rotary member 30 comes into contact with the lower end 41*b* of the second inclined surface 41 of the second rotary member 40 while the lower end 31*b* of the first inclined surface 31 comes into contact with the upper end 41*a* of the second inclined surface 41 as illustrated in FIG. 7, so the upper surfaces of the second rotary member 40 and the support member 80 are inclinedly positioned at the wobbling angle. Thus, the washing plate 60 mounted to the outer surface of the support member 80 is inclinedly arranged such that the position of the washing plate 60 is changed to the wobbling position. In such a state, when the inclined rotating shaft 22 rotates along with the second rotary member 40, the washing plate 60 wobbles in the vertical direction by a predetermined amplitude, without rotating regardless of the rotation of the inclined rotating shaft 22.

When the washing plate 60 wobbles, the washing plate 60 applies an impact to the laundry in the vertical direction while generating the water currents in the vertical direction, thus washing the laundry. Since the impact applied to the laundry and the wash water is proportional to the rotating speed of the washing shaft 6*b*, a desired washing effect is achieved when an amount and a rotating speed of the wash water are appropriately regulated according to a quantity of the laundry.

When the washing operation is complete, the wash water discharges to the outside through the drain hose 8. Next, the rinsing operation is performed to remove a detergent from the laundry. Thereafter, the cylindrical spin-drying tub 3 rotates at a high speed by the rotation of the spin-drying shaft 6*a*, thus performing the spin-drying operation to spin-dry the laundry.

To perform the spin-drying operation, when the inclined rotating shaft 22 rotates in the second rotating direction, that is, clockwise from the state illustrated in FIG. 11, the projecting pin 54 primarily comes into contact with the leveling pin 52 as illustrated in FIG. 8, and pushes the leveling pin 52 in the same direction (i.e., clockwise), so that the clutch 100 operates in a reverse order of the above-mentioned operation. At this time, the support member 80 is held by the second rotary member 40 and simultaneously the position of the washing plate 60 changes to the level position so that the washing plate 60 is horizontally arranged.

When the inclined rotating shaft 22 rotates clockwise to change the position of the wobbling unit 20 to the level position after the inclined rotating shaft 22 stops rotating counterclockwise in the state where the clutch pins 130 move into the corresponding pin holes 112 to remove the clutch pins 130 from the corresponding pin insertion holes 85 of the clutch guide 82, as illustrated in FIG. 11, the projecting pin 54 rotates, clockwise, so the projecting pin 54 does not push the wobbling pin 53 and the actuation pin 125 of the clutch 100 any longer. Thus, the clutch pins 130 are biased toward the inner cylindrical part 83 of the clutch guide 82 by elasticity of the springs 150. When the projecting pin 54, which is in contact with the wobbling pin 53, rotates at an angle of about 180° to come into contact with the leveling pin 52, the inclined surface 31 of the first rotary member 30 and the inclined surface 41 of the second rotary member 40 are positioned so that the upper surface of the second rotary member 40 is horizontally arranged.

Since the second rotary member 40 and the clutch 100 are not actuated by the projecting pin 54 until the projecting pin 54 comes into contact with the leveling pin 52, the second rotary member 40 and the clutch 100 are not rotated. When the projecting pin 54 further rotates clockwise as the projecting pin 54 is in contact with the leveling pin 52, the second rotary member 40 provided with the leveling pin 52 rotates, so the clutch 100 mounted to the second rotary member 40 rotates. While the clutch 100 rotates clockwise, each of the clutch pins 130 elastically inserts into the nearest pin insertion hole 85 of the clutch guide 82 by a restoring force of the corresponding spring 150, thus holding the support member 80. By such an operation, the support member 80 and the washing plate 60 rotate along with the second rotary member 40 as the support member 80 and the washing plate 60 are held by the clutch 100, thus spin-drying the laundry placed on the washing plate 60.

As described above, in the wobbling position, the impact is applied to the laundry in the vertical direction by the washing plate 60, and a further impact is applied to the laundry by the wash water flowing through a plurality of perforations 64 formed in the washing plate 60, so to effectively wash the laundry using a small amount of wash water is possible. Thus, a smaller amount of wash water is required, in comparison with conventional washing machines with pulsators which generate water currents to move the laundry.

According to the embodiment of the present invention, the wobbling unit 20 is provided with the vertical rotating shaft 21 at a position between the washing shaft 6*b* and the first rotary member 30. However, the wobbling unit may not be provided with the vertical rotating shaft 21. That is, the washing shaft 6*b* may not be connected to the vertical rotating shaft 21, but may be directly connected to the first rotary member 30, to accomplish a same effect as that of the embodiment of the present invention.

Further, according to the embodiment of the present invention, the projecting pin 54 is horizontally mounted to the upper portion of the inclined rotating shaft 22. However, the projecting pin 54 may be mounted to other elements without being limited to the inclined rotating shaft 22. That is, the projecting pin 54 may be mounted to one of the first rotary member 30, the vertical rotating shaft 21 and the washing shaft 6*b*, and the leveling pin 52 and the wobbling pin 53 may be mounted to predetermined positions of the second rotary member 40 corresponding to the position of the projecting pin 54, thus accomplishing the aspects of the present invention.

As is apparent from the above description, a washing machine is provided such that a washing plate wobbles in a vertical direction without rotating to wash laundry placed on the washing plate, thus preventing the laundry from twisting and entangling during a washing operation, therefore preventing the laundry from wearing out and being damaged. Further, a user does not need to disentangle the laundry and straighten the laundry to an original state thereof.

Further, a washing machine is provided such that a washing shaft rotates in a single direction to wash laundry, thus reducing a power consumption of a drive motor in comparison with a conventional washing machine and to increase a life span of the drive motor.

A washing machine is provided to wash laundry by a wobbling operation of a washing plate, thus allowing the laundry to be washed using a small amount of wash water, and dramatically reduces an amount of the wash water and detergent used. Such an effect is increasingly stressed in view of a saving of water and a protection of the environment.

Furthermore, a washing machine is provided such that a support member is held at a level position by a clutch provided at a position around a second rotary member and a support member so that a washing plate rotates along with the second rotary member, and the second rotary member stops and only an inclined rotating shaft rotates toward a wobbling pin although a large load is applied to the washing plate when changing a position of a wobbling unit from the level position to a wobbling position, thus reliably changing the position of the washing plate to the wobbling position.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A washing machine, comprising:

a washing shaft; and a wobbling unit mounted to the washing shaft so as to wash laundry by a wobbling operation, wherein the wobbling unit comprises:

an inclined rotating shaft to form a predetermined angle with a longitudinal axis of the washing shaft;

a first rotary member rotating along with the washing shaft and provided with a first inclined surface, the first inclined surface being inclined to form a predetermined angle with a latitudinal axis of the washing shaft;

a second rotary member installed to rotate with respect to the first rotary member and provided with a second inclined surface corresponding to the first inclined surface of the first rotary member, with an axial bore formed through the second rotary member to rotatably receive the inclined rotating shaft therein;

a washing plate arranged at a wobbling position when the second rotary member rotates in a first rotating direction, and arranged at a level position when the second rotary member rotates in a second rotating direction; and a clutch to hold the second rotary member when a position of the washing plate changes from the level position to the wobbling position to prevent the second rotary member from rotating along with the first rotary member.

2. The washing machine according to claim 1, wherein the wobbling unit further comprises;

a projecting pin mounted to one of the washing shaft, the first rotary member, and the inclined rotating shaft so that the projecting pin rotates along with the one of the washing shaft, the first rotary member, and the inclined rotating shaft; and a wobbling pin and a leveling pin provided on the second rotary member and spaced apart from each other by a predetermined interval.

3. The washing machine according to claim 2, wherein the inclined rotating shaft is received in the axial bore of the second rotary member to project from an upper end of the second rotary member, the projecting pin horizontally extends from the inclined rotating shaft at a position above the second rotary member, and the leveling pin and the wobbling pin are provided on the upper end of the second rotary member on opposite sides of a center of the second rotary member so that the leveling pin and the wobbling pin form an angle of about 180° with each other such that the projecting pin comes into contact with the wobbling pin so that a position of the washing plate changes to the wobbling position, when the inclined rotating shaft rotates in the first rotating direction, and the projecting pin comes into contact with the leveling pin so that the position of the washing plate changes to the level position, when the inclined rotating shaft rotates in the second rotating direction.

4. The washing machine according to claim 3, wherein the first inclined surface is formed at an upper end of the first rotary member and the second inclined surface is formed at a lower end of the second rotary member such that the upper end of the second rotary member is horizontally positioned so that the washing plate is positioned at the level position, when the projecting pin comes into contact with the leveling pin, and the upper end of the second rotary member is inclinedly positioned so that the washing plate is positioned at the wobbling position, when the projecting pin comes into contact with the wobbling pin.

5. The washing machine according to claim 4, wherein the first inclined surface of the first rotary member and the second inclined surface of the second rotary member have an inclination angle of about 5° to 20°.

6. The washing machine according to claim 4, wherein the wobbling unit further comprises:

a support member to rotatably receive the second rotary member and the washing plate; and a bearing interposed between the second rotary member and the washing plate, to mount the support member to the second rotary member.

7. The washing machine according to claim 6, wherein the support member comprises:

a plurality of projecting ribs vertically provided on an outer surface of the support member; and a plurality of grooves provided on an inner surface of a hole formed at a center of the washing plate to correspond to the projecting ribs, so that the washing plate is mounted to the support member using the plurality of projecting ribs and the plurality of grooves.

8. The washing machine according to claim 1, wherein the wobbling unit further comprises:

a vertical rotating shaft provided between the washing shaft and the first rotary member to transmit a driving force from the washing shaft to the first rotary member, the vertical rotating shaft being mounted at an upper end thereof to a lower end of the first rotary member and mounted at a lower end thereof to the washing shaft.

9. The washing machine according to claim 8, wherein:

the vertical rotating shaft and the washing shaft have a plurality of spline ribs, respectively provided around a lower portion of the vertical rotating shaft and an upper portion of the washing shaft, the wobbling unit further comprises:

a boss provided at a junction of the vertical rotating shaft and the washing shaft, the boss being provided on an inner surface thereof with a plurality of spline grooves to engage with respective spline ribs of the vertical rotating shaft and the washing shaft so that the vertical rotating shaft is connected to the washing shaft via the boss.

10. The washing machine according to claim 8, further comprising:

a spin-drying tub in which the washing plate is set; and a housing rotatably supporting the vertical rotating shaft and mounted to a bottom of the spin-drying tub, the wobbling unit further comprises:

a bearing interposed between the vertical rotating shaft and the housing.

11. The washing machine according to claim 8, wherein the wobbling unit further comprises:

locking pins latitudinally penetrating the upper end of the vertical rotating shaft and a lower end of the inclined rotating shaft, respectively, so that the vertical rotating shaft and the inclined rotating shaft are locked to the first rotary member, the locking pins locking the upper end of the vertical rotating shaft and the lower end of the inclined rotating shaft to the first rotary member.

12. The washing machine according to claim 10, wherein the wobbling unit further comprises:

a covering plate provided along an outer edge of the washing plate to cover a gap formed between the washing plate and the spin-drying tub.

13. The washing machine according to claim 10, wherein the wobbling unit further comprises:

a support member to rotatably receives the second rotary member and the washing plate; and a holder mounted at opposite ends thereof to the support member and the housing to prevent the support member from moving by a rotation of the second rotary member.

14. The washing machine according to claim 6, wherein the support member comprises:

a clutch guide provided on a top of the support member so that the support member engages with or disengages from the clutch.

15. The washing machine according to claim 14, wherein the clutch comprises:

a clutch body mounted to the second rotary member;

a clutch pin provided at a predetermined position of the clutch body to move into or move out of the clutch body such that the clutch pin engages with or disengages from the clutch guide;

a rotating plate rotatably mounted to the clutch body;

an actuation cam fastened to the clutch pin to move the clutch pin in an inward direction by a rotation of the rotating plate; and a spring provided in the clutch body to bias the clutch pin in an outward direction, the clutch pin moving in the inward direction by the actuation cam when the rotating plate rotates in the first rotating direction to disengage from the clutch guide, and the clutch pin moving in the outward direction by the spring when the rotating plate rotates in the second rotating direction to engage with the clutch guide.

16. The washing machine according to claim 15, wherein the clutch comprises:

a setscrew loosely tightened to a center of the clutch body after passing through a center of the rotating plate, the clutch body being arranged along a diameter of the rotating plate, and the rotating plate being rotatably mounted to the clutch body by the setscrew.

17. The washing machine according to claim 15, wherein an arc-shaped opening is formed at the rotating plate to extend from a position around an outer edge of the rotating plate to a position around the center of the rotating plate, so that the actuation cam moves to the center of the rotating plate along an arc-shaped edge of the arc-shaped opening to move the clutch pin in the inward direction, when the rotating plate rotates in the first direction.

18. The washing machine according to claim 17, wherein the clutch body comprises:

a pin hole bored from an end of the clutch body toward a center of the clutch body to receive the clutch pin in the clutch body so that the clutch pin moves in one of the inward and outward directions, and a cam hole provided at a top of the clutch body to communicate with the pin hole so that the actuation cam fastens to the clutch pin and moves along the clutch body.

19. The washing machine according to claim 18, wherein the spring is provided in the pin hole to bias the clutch pin in the outward direction.

20. The washing machine according to claim 18, wherein the clutch further comprises:

a setscrew tightened to an inside end of the clutch pin, wherein the actuation cam loosely fits over the setscrew so that the actuation cam moves along the arc-shaped edge of the arc-shaped opening while rotating on an axis of the clutch.

21. The washing machine according to claim 19, wherein the clutch further comprises:

an actuation pin provided on a lower surface of the rotating plate so as to downwardly project from the rotating plate such that the projecting pin pushes the actuation pin when the inclined rotating shaft rotates in the first rotating direction to rotate the rotating plate.

22. The washing machine according to claim 21, wherein a central angle of the arc-shaped opening is larger than an angle formed between the actuation pin and the wobbling pin.

23. The washing machine according to claim 22, wherein a length of the clutch pin projecting from the clutch body by an elasticity of the spring is determined according to a rotated angle of the actuation pin which rotates by the projecting pin until the actuation pin is adjacent to the wobbling pin.

24. The washing machine according to claim 21, wherein the clutch guide comprises:

a cylindrical part provided at a predetermined position which is spaced apart from an outer casing of the support member by a predetermined interval; and at least two connecting parts connecting the cylindrical part to the outer casing of the support member, and arranged to face each other, with a pin insertion hole being provided at each of the connecting parts so that the clutch pin projecting from the pin hole inserts into and is stopped by a respective pin insertion hole.

25. The washing machine according to claim 15, further comprising:

a base downwardly extending from a lower surface of the clutch body to mount the clutch body to the second rotary member.

26. The washing machine according to claim 9, wherein the boss comprises:

an annular step horizontally provided around a center portion on the inner surface of the boss to separate the washing shaft from the vertical rotating shaft.

27. The washing machine according to claim 1, wherein the first and second inclined surfaces of the first and second rotary members, respectively, have a common angle.

28. The washing machine according to claim 1, wherein when the washing plate is at the level position, the washing plate is positioned to perform a spin-drying operation.

29. The washing machine according to claim 1, wherein a gap is formed between the inclined rotating shaft and the axial bore formed through the second rotary member so that the inclined rotating shaft is rotatable in the second rotary member.

30. The washing machine according to claim 1, wherein the washing plate comprises:

a central portion to couple with the washing shaft; and a wing part portion on which laundry is placed downwardly and integrally extending from the central portion, the wing part being provided with a plurality of perforations to allow wash water to flow in a vertical direction.

31. A washing machine, comprising:

a washing shaft; and a wobbling unit performing a leveling operation when the washing shaft rotates in a first rotating direction and coupled to the washing shaft and performing a wobbling operation when the washing shaft rotates in a second rotating direction, the wobbling unit comprising:

a first rotary member rotating along with the washing shaft and having a first rotatable inclined surface;

a second rotary member rotating with respect to the first rotary member and having a second rotatable inclined surface corresponding to the first rotatable inclined surface of the first rotary member;

a washing plate arranged at a wobbling position when the second rotary member rotates in a first rotating direction, and arranged at a level position when the second rotary member rotates in a second rotating direction;

a clutch to couple the second rotary member to the washing plate when a position of the washing plate is in the wobbling position to prevent the second rotary member from rotating along with the first rotary member.

32. The washing machine according to claim 31, wherein the wobbling unit further comprises:

an inclined rotating shaft to form a predetermined angle with a longitudinal axis of the washing shaft and having a projecting pin projecting therefrom so that the projecting pin rotates along with the inclined rotating shaft; and a wobbling pin and a leveling pin provided on the second rotary member at spaced apart positions from each other, wherein the projecting pin of the inclined rotating shaft comes into contact with the wobbling pin just before the clutch releases the washing plate and defines the wobbling position of the washing plate.

33. The washing machine according to claim 31, wherein the wobbling unit further comprises:

an inclined rotating shaft installed to form a predetermined angle with a longitudinal axis of the washing shaft and having a projecting pin projecting therefrom so that the projecting pin rotates along with the inclined rotating shaft; and a wobbling pin and a leveling pin provided on the second rotary member at spaced apart positions from each other, wherein the projecting pin of the inclined rotating shaft comes into contact with the leveling pin just before the clutch releases the washing plate and defines the leveling position of the washing plate.

* * * * *

UNITED STATES PATENT AND TRADEMARK OFFICE

CERTIFICATE OF CORRECTION

PATENT NO. : 7,316,134 B2
APPLICATION NO. : 10/739264
DATED : January 8, 2008
INVENTOR(S) : Myung-Gyu Lee et al.

It is certified that error appears in the above-identified patent and that said Letters Patent is hereby corrected as shown below:

Column 17, Line 32, after “comprises” change “;” to --:--.

Column 18, Line 34, after “respectively” insert --,--.

Signed and Sealed this

Fifth Day of August, 2008

JON W. DUDAS
*Director of the United States Patent and Trademark Office*